US009290037B2

(12) United States Patent
Vleisides et al.

(10) Patent No.: US 9,290,037 B2
(45) Date of Patent: Mar. 22, 2016

(54) WRITING INSTRUMENT SHEATH

(71) Applicants: Nicholas Leo Vleisides, Danville, CA (US); Todd Michael Weinberg, Danville, CA (US)

(72) Inventors: Nicholas Leo Vleisides, Danville, CA (US); Todd Michael Weinberg, Danville, CA (US)

(73) Assignee: PENCIL SKINS, LLC, Danville, CA (US)

( * ) Notice: Subject to any disclaimer, the term of this patent is extended or adjusted under 35 U.S.C. 154(b) by 222 days.

(21) Appl. No.: 13/902,735

(22) Filed: May 24, 2013

(65) Prior Publication Data

US 2014/0348564 A1 Nov. 27, 2014

(51) Int. Cl.

| | |
|---|---|
| ***A46B 5/02*** | (2006.01) |
| ***B43K 23/00*** | (2006.01) |
| ***B43K 23/008*** | (2006.01) |
| ***B43K 23/016*** | (2006.01) |
| ***B43K 29/007*** | (2006.01) |

(52) U.S. Cl.

CPC ..... *B43K 23/00* (2013.01); *B43K 23/008* (2013.01); *B43K 23/016* (2013.01); *B43K 29/007* (2013.01)

(58) Field of Classification Search

CPC ..... B43K 23/00; B43K 23/016; B43K 23/008
USPC ..... 401/6, 88
See application file for complete search history.

(56) References Cited

U.S. PATENT DOCUMENTS

| | | | | |
|---|---|---|---|---|
| 2,371,639 | A | 3/1945 | Mason | |
| 3,072,955 | A | 1/1963 | Mitchell | |
| 4,601,598 | A * | 7/1986 | Schwartz et al. | 401/6 |
| D372,865 | S | 8/1996 | Stowell et al. | |
| 5,601,327 | A | 2/1997 | Cho | |
| 5,926,912 | A | 7/1999 | Claphan | |
| 6,591,456 | B2 * | 7/2003 | DeLuca et al. | 16/431 |
| 6,752,556 | B2 * | 6/2004 | Pearce | 401/6 |
| 7,004,655 | B2 * | 2/2006 | Ferrara | 401/6 |
| 7,673,770 | B2 | 3/2010 | Summerfield | |
| 2012/0318707 | A1 * | 12/2012 | Zivitz et al. | 206/575 |

* cited by examiner

*Primary Examiner* — Jennifer C Chiang
(74) *Attorney, Agent, or Firm* — Blakely Sokoloff Taylor & Zafman LLP

(57) ABSTRACT

Writing instrument sheaths and methods of fabricating and using the writing instrument sheaths are disclosed. In an embodiment, a writing instrument sheath includes a contiguous wall and a polymer layer that provides a comfortable and controllable writing experience.

20 Claims, 6 Drawing Sheets

A-A

WRITING INSTRUMENT SHEATH

BACKGROUND OF THE INVENTION

1. Field of the Invention

Embodiments of the present invention relate to the field of writing. More specifically, embodiments of the present invention relate to sheaths that promote comfort and control while using a writing instrument, and which facilitate an ergonomic and enjoyable writing experience.

2. Discussion of Related Art

Sleeves and coverings to facilitate a user's grasp of various tools and implements exist. For example, various pen and pencil grips have been used to help teach children to write correctly and to make writing more comfortable for all writers. However, such grips have generally been made from rigid polymers with tacky surfaces and/or various contours and surface features to improve tactile gripping. Consistent with the rigid material properties of these grips, longitudinal slits or breaks are generally formed in the grip walls to allow the grip to be pried open and wrapped around the longitudinal axis of a pencil or pen. More specifically, since the grips are rigid, the break in the wall is required to allow the grip to expand around the pencil or pen in order to be retained by a press fit therewith. Likewise, since these grips generally have broken walls, these grips must be rigid to resist inadvertent widening of the slit, which can result in dislodgment from the pencil or pen. Thus, existing pencil grips are generally not compliant or conformable to a writer's grip, nor are they longitudinally compressible to facilitate adjusting, e.g., sharpening, of a pencil or pen.

SUMMARY OF THE DESCRIPTION

A writing instrument sheath and methods of using and manufacturing a writing instrument sheath are disclosed. In an embodiment, the writing instrument sheath includes a cylindrical inner surface, an outer surface, a contiguous wall between the inner surface and the outer surface, and a seam through the contiguous wall. The wall remains contiguous under circumferential stress, such as when the writing instrument sheath is loaded over a pen or pencil.

In an embodiment, the writing instrument sheath may also include a first end longitudinally separated from a second end by the contiguous wall, and the seam may extend between the ends. For example, the seam may extend longitudinally between the ends over a length greater than about 10 cm. The writing instrument sheath may also include a junction, such as a stitch that joins the contiguous wall along the seam. For example, the stitch may be a chain, lock, multithread chain, overedge, or cover stitch.

In an embodiment, the contiguous wall may include a composite structure. For example, the composite structure may have an outer textile layer of stretchable fabric around a polymer layer of closed-cell foam. More particularly, the outer textile layer may be nylon or spandex fabric and the polymer layer may be a polychloroprene, rubber, polyethylene, silicone, or nitrile foam. In an embodiment, the outer surface of the writing instrument sheath may include one or more gripping features, such as indentations, bumps, holes, and ridges. Furthermore, the polymer layer may have a Shore OO durometer less than 30 and a thickness of between about 2 to 4 mm. The composite structure may also include an inner textile layer radially inward from the polymer layer.

A method of fabricating a writing instrument sheath is disclosed, including laminating an outer textile layer on a first surface of a polymer layer such that the laminated layers share a first edge and a second edge, juxtaposing the first edge and the second edge along a seam with the outer textile layer radially outward from the polymer layer, and joining the first edge and the second edge along the seam. The method may also include laminating an inner textile layer on a second surface of the polymer layer, such that the inner textile layer shares the first edge and the second edge with the other layers and the inner textile layer is radially inward from the polymer layer after joining. The joining of the first edge and second edge may include stitching the first edge to the second edge. Furthermore, in an embodiment, the polymer layer may include a closed-cell polychloroprene foam.

BRIEF DESCRIPTION OF THE DRAWINGS

The present invention is illustrated by way of example and not limitation in the figures of the accompanying drawings in which like references indicate similar, but not necessarily identical, elements.

DETAILED DESCRIPTION

Figure 1:
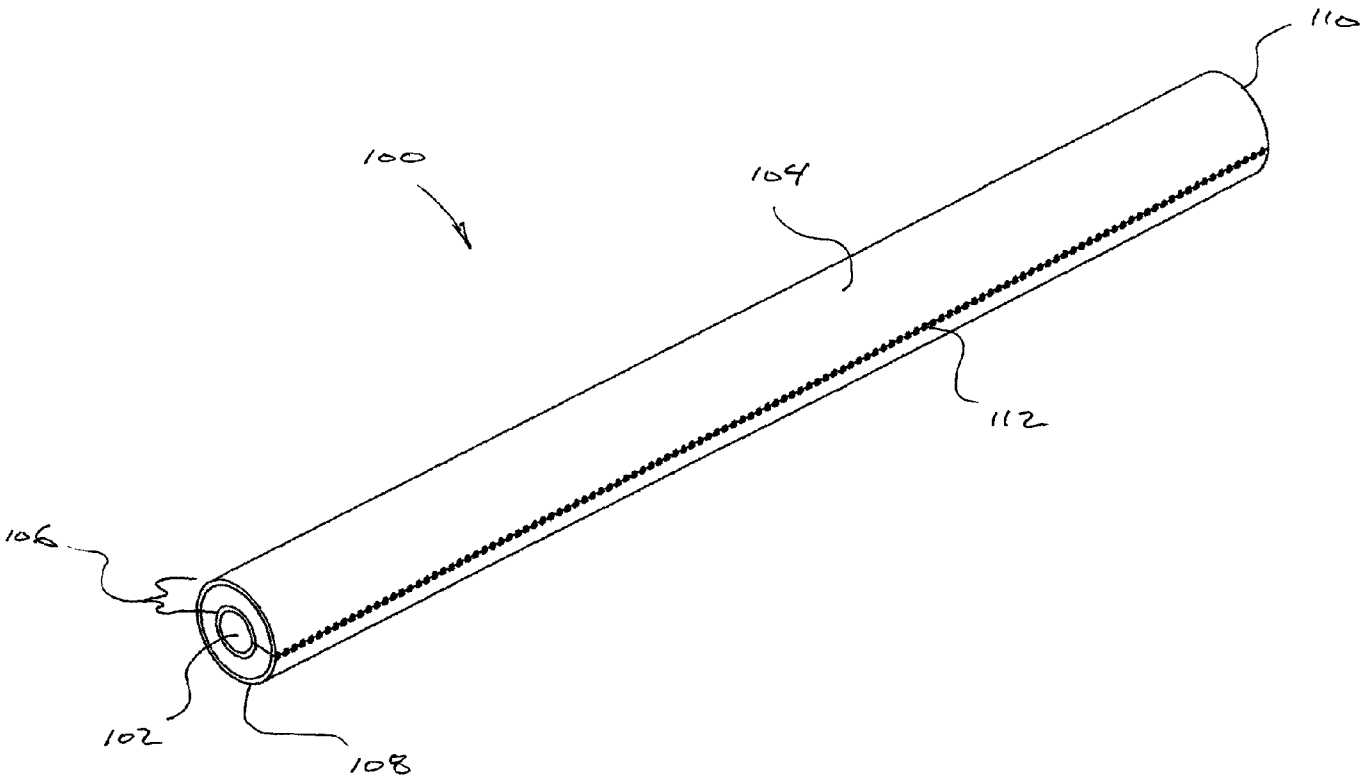
FIG. 1 is a perspective view illustration of a writing instrument sheath in accordance with the invention.

Various embodiments and aspects of the invention will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the invention. However, in certain instances, well-known or conventional details are not described in order to provide a concise discussion of embodiments of the present invention.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment. Although the processes are described below in terms of some sequential operations, it should be appreciated that some of the operations described may be performed in a different order. Moreover, some operations may be performed simultaneously rather than sequentially.

It is to be understood that embodiments of the current invention may be used to cover portions of wooden pencils, mechanical pencils, ink pens, and many other kinds of writing instruments. Furthermore, embodiments of the current invention may be applied to other objects beyond writing instruments, where such objects can be used with a conformable and compliant sheath to facilitate comfortable gripping and variable handle lengths. For example, embodiments of the current invention may be used as a sheath for a fishing rod, a motorcycle fork, a tool such as a hammer, a rifle barrel, or a hot drink cup. This list is not exhaustive, and is intended only to name a few other objects that may be gripped using a sheath as described below.

In an aspect, a writing instrument sheath is provided that may be slid over the end of a variety of writing instruments having varying diameters. In an embodiment, the writing instrument sheath is constructed with a polymer material that is compliant and includes an inner diameter that can radially expand to accommodate pens and pencils of larger or smaller diameters. The writing instrument sheath may also include a wall that remains contiguous under a circumferential stress induced by this radial expansion, and thus provides for an evenly distributed press fit around the circumference of the pens and pencils. In addition, the writing instrument sheath may be resilient to avoid permanent stretching and thus to allow the writing instrument sheath to be interchangeably placed over writing instruments of varying diameters.

In another aspect, the writing instrument sheath is ergonomically constructed. In an embodiment, the compliant material provides a cushioned surface that reduces writing fatigue by reducing pressure points when gripping a pen or pencil. In addition to being compliant, the writing instrument sheath may include a fabric layer that is touched directly while writing. The fabric layer may be smooth, non-tacky, and have a low coefficient of friction to permit the user to easily change grips while writing. The writing instrument sheath may also be of sufficient length to be in contact with both a writer's fingers when gripped, as well as with an oblique arch between the thumb and index finger. Thus, in this embodiment, only the writing instrument sheath, and no part of the writing instrument, contacts the writing hand.

In another aspect, the writing instrument sheath may be configured to facilitate repositioning of the writing instrument sheath, which accommodates adjustments to the pen or pencil. In an embodiment, the writing instrument sheath includes an inner textile layer that grips the writing instrument when radially pinched, e.g., as while writing, but can be easily slid over a pen and pencil when the grip is not pinched and a longitudinal load is applied to this grip. Additionally, the writing instrument sheath may be longitudinally compressible such that applying a longitudinal load on one end while holding the other end causes the writing instrument sheath to reduce in overall length. Thus, the writing instrument sheath may remain in place over a pencil while it is being sharpened. After sharpening, the sheath may be designed to resiliently extend back to its original position after the sharpening, or to remain shortened. Alternatively, the writing instrument sheath may be slid away from the writing tip as the pencil is sharpened and shortened.

In another aspect, the writing instrument sheath is configured to allow a writer to lengthen or shorten the sheath as needed. In an embodiment, the writing instrument sheath incorporates a stitched seam. The stitched seam not only allows for the wall to remain contiguous under radial expansion as described above, but it also allows for the writing instrument sheath to be axially shortened from an initial length. More particularly, as compressive axial loading is applied to both ends of the writing instrument sheath, a wall of the writing instrument sheath bunches up, forming an undulating writing instrument sheath outer surface. The writing instrument sheath length may remain shortened even when the axial loading is removed. For example, the stitched seam may include connected locations that grip the pencil sufficiently to prevent the writing instrument sheath from automatically returning to an initial length, even under the resilience of one or more unconnected and bunched locations.

Referring to FIG. 1 a perspective view of a writing instrument sheath is shown in accordance with the invention. The writing instrument sheath 100 includes an inner surface 102, which may be an elongated cylindrical surface. Writing instrument sheath 100 may also include an outer surface 104 radially offset from the inner surface 102. Thus, in an embodiment, the outer surface 104 may include a similar shape to inner surface 102, e.g., may be an elongated cylindrical surface. However, in other embodiments, outer surface 104 may have a shape that does not conform to inner surface 102. For example, outer surface 104 may have a wavy, undulating, or otherwise contoured shape. Writing instrument sheath 100 may further include a wall 106 having a thickness between inner surface 102 and outer surface 104. Thus, the thickness of wall 106 may vary from a first end 108 of writing instrument sheath 100 to a second end 110 of writing instrument sheath 100, depending upon whether inner surface 102 and outer surface 104 have identical profiles. In an embodiment, thickness of wall 106 may be in a range of about 1 to 10 mm on average. More particularly, thickness of wall 106 may be in a range of about 2 to 4 mm.

In an embodiment, writing instrument sheath 100 includes a seam 112 running between first end 108 and second end 110. The seam 112 may be formed through wall 106. For example, in an embodiment, seam 112 is formed by bringing together two lateral edges of a single sheet to form the cylindrical body shown in FIG. 1. Thus, in an embodiment, seam 112 extends through the entire thickness of wall 106. Alternatively, seam 112 may only extend through a portion of wall 106. For example, seam 112 may be a slit formed through about 0.5 to 0.9 of the thickness of wall 106.

Figure 2:
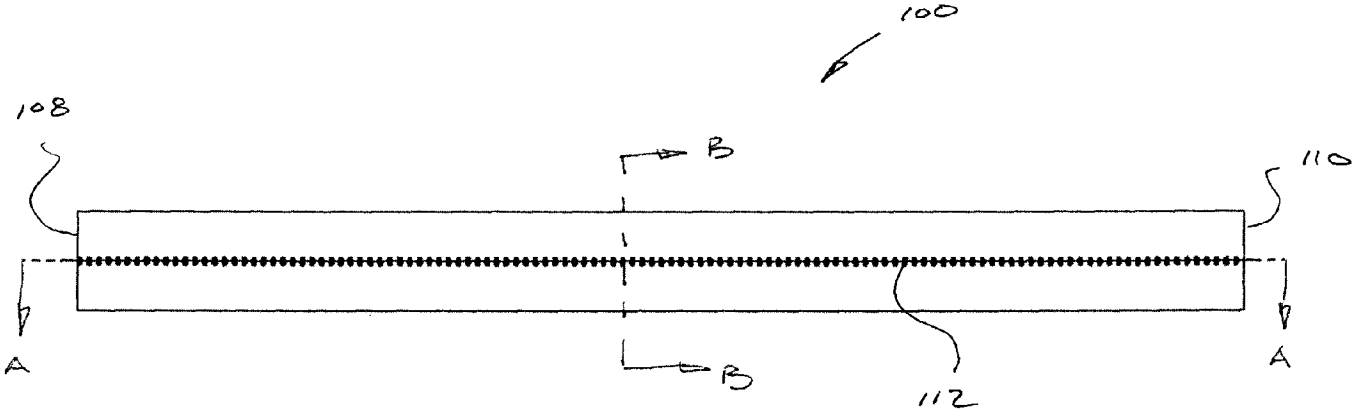
FIG. 2 is a side view illustration of a writing instrument sheath in accordance with the invention.

Referring to FIG. 2 a side view of a writing instrument sheath is shown in accordance with the invention. Seam 112 may extend longitudinally in a straight line that aligns with an axis of writing instrument sheath 100 between first end 108 and second end 110. Alternatively, seam 112 may extend between first end 108 and second end 110, but in a non-linear direction. For example, seam 112 may extend between the ends along an arcuate path, such as a helix. Alternatively, seam 112 may extend between the ends along a non-linear, non-smooth path, such as a zig-zag path. In another embodiment, seam 112 may not extend entirely between the ends. For example, seam 112 may extend from first end 108 for between about 0.3 to 0.8 times the length of writing instrument sheath 100. In an embodiment, a length of writing instrument sheath 100 may be in a range of between about 5 to 20 cm. More particularly, a length of writing instrument sheath 100 may be in a range of between about 10 to 12 cm.

Figure 3:
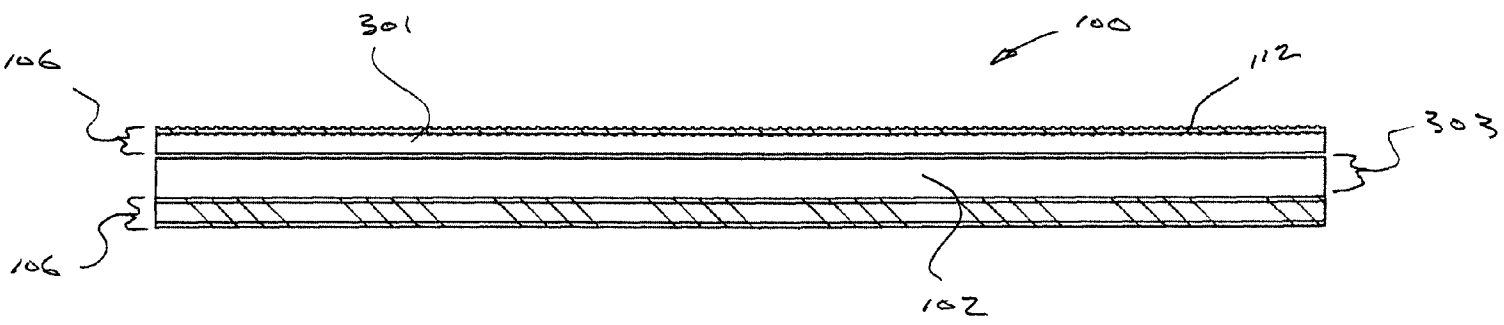
FIG. 3 is a cross-sectional view, taken about line A-A of FIG. 2, illustrating a writing instrument sheath in accordance with an embodiment of the invention.

Referring to FIG. 3 a cross-sectional view, taken about line A-A of FIG. 2, illustrating a writing instrument sheath is shown in accordance with an embodiment of the invention. Writing instrument sheath 100 may include a first edge 301 defined by a surface of wall 106 within seam 112. For example, seam 112 may be formed by the lateral edges of a sheet of material that is rolled into a cylinder to bring the lateral edges together. Accordingly, seam 112 may include first edge 301 corresponding to wall 106 defined by one lateral edge and seam 112 may also include a second edge corresponding to wall 106 defined by another lateral edge. Furthermore, inner surface 102 may define a central lumen 303 to receive a writing instrument once seam 112 is closed by joining wall 106 along first edge 301 and second edge. In an embodiment, central lumen 303 may have a diameter of between about 6 to 10 mm. Thus, in an embodiment, an overall diameter of writing instrument sheath 100 may be equal to the diameter of central lumen 303 plus twice the thickness of wall 106, e.g., in a range of about 8 to 27 mm. More particularly, the overall diameter of writing instrument sheath 100 may be in a range of about 8 to 15 mm.

Figure 4:
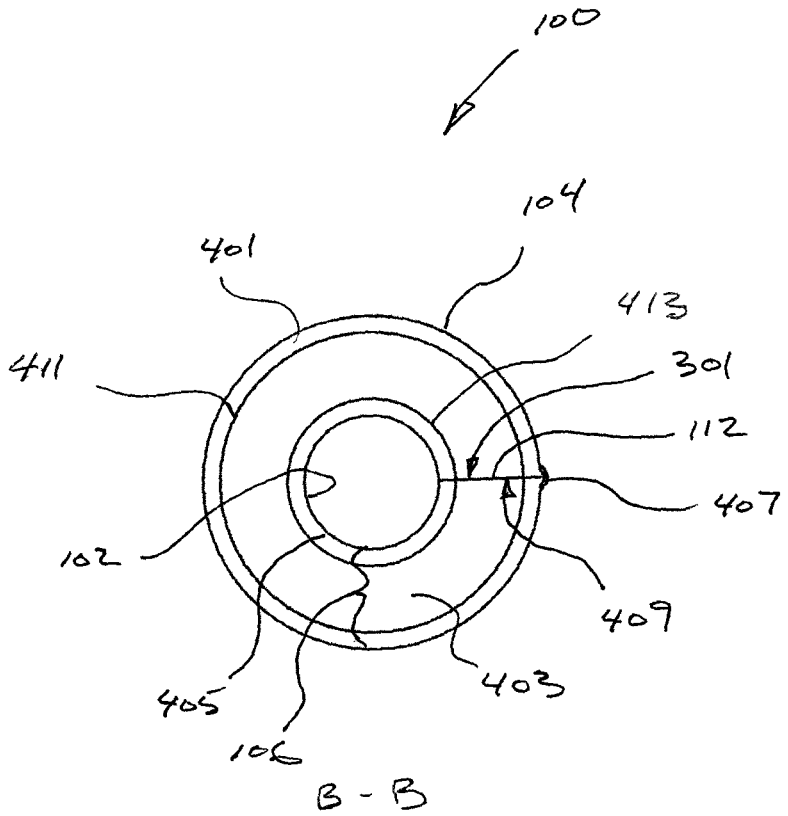
FIG. 4 is a cross-sectional view, taken about line B-B of FIG. 2, illustrating a writing instrument sheath in accordance with an embodiment of the invention.

Referring to FIG. 4 a cross-sectional view, taken about line B-B of FIG. 2, illustrating a writing instrument sheath is shown in accordance with an embodiment of the invention. Wall 106 may be a composite structure including a plurality of layers. For example, wall 106 may include at least two layers, i.e., an inner and an outer layer. Alternatively, wall 106 may include at least three layers, i.e., an inner layer, an intermediate layer, and an outer layer. The choice of the number of layers may depend on the intended structural properties of each layer. For example, in an embodiment, writing instrument sheath 100 may include an outer textile layer 401, an intermediate polymer layer 403, and optionally, an inner textile layer 405.

Outer textile layer 401 may be configured to have a low coefficient of friction with human skin. More particularly, outer textile layer 401 may be configured to provide a smooth, non-tacky, low friction grip that allows a writer to slide their fingers easily over the surface to change a gripping position. Accordingly, in an embodiment, outer textile layer 401 may include a fabric that is smooth and stretchable, such as nylon, lycra, or spandex fabric. Outer textile layer 401 may include a thickness of about 0.5 mm.

In another embodiment, in addition to having a low coefficient of friction with skin, e.g., not being tacky, outer textile layer 401 may nonetheless include features to promote gripping. For example, outer textile layer 401 may include gripping features such as indentations, bumps, holes, and ridges over at least a portion of outer surface 104.

In an embodiment, outer textile layer 401 may provide a surface suited to be printed upon. For example, outer textile layer 401 may be printed or silk screened with a variety of characters, symbols, or other marks. More particularly, outer textile layer 401 may be printed with various designs, logos, words, or phrases of different colors and patterns. In one embodiment, writing instrument sheath 100 may be configured for marketing and/or promotional use. In this embodiment, writing instrument sheath 100 may be printed with a logo, trademark, name, etc. of a business, product, or service for use as a promotional item. This promotional use of a writing instrument sheath 100 may be facilitated by outer textile layer 401. For example, outer textile layer 401 may include printable surfaces and/or the surfaces may be surface treated with, e.g., a polymer overcoat, to enable printing to be performed more easily on outer textile layer 401.

Intermediate polymer layer 403 may be configured to permit a writer to grip writing instrument sheath 100 and have writing instrument sheath 100 conform to the pressure and shape of the gripping fingers. In an embodiment, polymer layer 403 may be formed from a foam, such as a closed-cell foam, that includes an air-filled matrix of material that can be resiliently compressed. For example, polymer layer 403 may be formed from polychloroprene, e.g., neoprene, having a Shore OO durometer of less than about 30. For example, polymer layer 403 may be polychloroprene with a Shore OO durometer of about 20. In other embodiments, polymer layer 403 may be a foam with an open or closed-cell configuration, including closed-cell foams incorporating natural rubber, synthetic or vulcanized rubber, polyethylene, polyurethane, urethane, nitrile, and silicone. Due to the low durometer of polymer layer 403, writing instrument sheath 100 may be flexible, pliable, and/or spongy, allowing it to conform to a writer's grip. Polymer layer 403 may have a thickness of about 2 mm.

Intermediate polymer layer 403 may also be configured to permit a writer to compress a writing instrument sheath 100 longitudinally by placing an axial load at either end. Due to the low durometer of polymer layer 403, writing instrument sheath 100 may be manipulated lengthwise along a longitudinal axis so as to shorten in length over a pencil or pen. This allows for frequent sharpening of, e.g., a wooden pencil, by facilitating insertion of the pencil into a sharpener while the sharpener presses longitudinally on the writing instrument sheath 100 and shortens the writing instrument sheath 100. In an embodiment, the axial stiffness of writing instrument sheath 100 is rigid enough to hold its form in a vertical position and has a maximum angle with the horizon of about 10 degrees when held horizontally at one end. In an embodiment, the axial stiffness of writing instrument sheath 100 is such that pressing on one end of writing instrument sheath 100 with a longitudinal force of about 0.5 to 1 pound while holding the other end will cause writing instrument sheath 100 to compress lengthwise.

Inner textile layer 405 may also include an inner surface 102 configured to slip over a writing instrument sheath 100 while also having sufficient friction with the writing instrument to grip the instrument when a writer grips the writing instrument sheath 100. In an embodiment, inner textile layer 405 may be optional, since the surface characteristics of polymer layer 403 may be sufficient to achieve the desired gripping and slipping just described. However, in an embodiment, inner textile layer 405 may incorporate a fabric, such as nylon, lycra, or spandex fabric, similar to the fabric used in outer textile layer 401. Accordingly, inner textile layer 405 can grip the writing instrument sheath 100 when pinched, or slide over the writing instrument sheath 100 when an axial load is applied to either end. In other embodiments, a surface treatment may be applied to inner surface 102 on either polymer layer 403 or inner textile layer 405 to achieve the desired slipping and gripping characteristics. For example, an adhesive may be sprayed onto either surface in a quantity that grips the writing instrument only when squeezed. Inner textile layer 405 may include a thickness of about 0.5 mm.

In an embodiment, the composite layers, e.g., outer textile layer 401, polymer layer 403, and inner textile layer 405, may be laminated over each other. For example, outer textile layer 401 may be laminated on polymer layer 403 at an outer interface 411. Similarly, inner textile layer 405 may be laminated on polymer layer 403 at an inner interface 413. Both interfaces may include a thermal or adhesive bond, as described below.

In an embodiment, seam 112 may include first edge 301 juxtaposed with second edge 409, i.e., by the surface of wall 106 at each edge being opposed to the surface of wall 106 at the other edge. Seam 112 may be closed by a junction 407. Junction 407 may include any of a number of different elements and manners for joining first edge 301 and second edge 409. For example, in an embodiment, an adhesive bond may be formed by gluing first edge 301 to second edge 409. Alternatively, a thermal bond may be formed by heating and pressing first edge 301 against second edge 409. In another embodiment, stitching may be used to stitch 701 first edge 301 to second edge 409 at seam 112.

Thus, junction 407 may be continuous along seam 112, or it may be discontinuous. More particularly, junction 407 may have one or more connection points and one or more unconnected points. In the case of stitching, junction 407 has a connection point in the location where a stitch holds first edge 301 near or against second edge 409. Likewise, in the case of stitching, junction 407 has an unconnected point at locations between the stitches, in which first edge 301 is not directly held together with second edge 409. In alternative embodiments, connected points may be formed with adhesive or thermal welding spots, for example, placed intermittently along seam 112 to allow for several unconnected points therebetween. Of course, junction 407 may also be formed continuously along seam 112, such as by have an adhesive bead from first end 108 to second end 110 without allowing for any gaps along the adhesive weld.

Stitching of junction 407 may include threads of various types, including braided and monofilament threads, e.g., fabricated from polyester. In an embodiment, the threads may be stretchable, to provide some degree of separation between first edge 301 and second edge 409 as writing instrument sheath 100 slides over a writing instrument, while ensuring that the wall 106 remains contiguous through the material of junction 407 at connection points. Stitching of junction 407 may also be of a variety of types of stitches. For example, in an embodiment, stitching may include one or more chain, lock, multithread chain, overedge, or cover stitch. Other similar types of stitches, such as zigzag, flatlock, and blind stitches, may be used. In an embodiment, the stitched seam 112 may be finished by gluing or taping over the stitching, or by other known seam 112 finishing techniques.

Junction 407 closes seam 112 at the one or more connection points and provides for writing instrument to maintain a contiguous wall 106. More specifically, writing instrument sheath 100 may be slid over a writing instrument without wall 106 being broken or stretched open. As a result, as writing instrument sheath 100 slides over a writing instrument having a diameter larger than central lumen 303, wall 106 will stretch and expand to accommodate the diameter of the writing instrument. More specifically, the contiguous wall 106 stretches outward in a radial direction as a writing instrument is loaded through central lumen 303, and the stretching results in a uniform circumferential tensile stress throughout wall 106. This circumferential tensile stress is a result of the wall 106 being contiguous and unable to break open at seam 112. If seam 112 were not closed by junction 407, expansion would not result in uniform circumferential tensile stress, but rather, wall 106 would see varying tensile and compressive stresses distributed throughout the wall. Comparatively, a uniform circumferential stress throughout wall 106 may be more likely to cause a uniform press fit about the circumference of the writing instrument than would be the case with a varying stress profile in wall 106. As a result, the uniform press fit may prevent the writing instrument sheath 100 from dislodging from the writing instrument.

In an embodiment, central lumen 303 of writing instrument sheath 100 may initially be about 20% less than a diameter of a standard wooden pencil. However, the elasticity of wall 106 may allow for writing instrument sheath 100 to accommodate an increase in central lumen 303 diameter such that central lumen 303 diameter is 40% greater than an initial diameter of outer surface 104.

Figure 5:
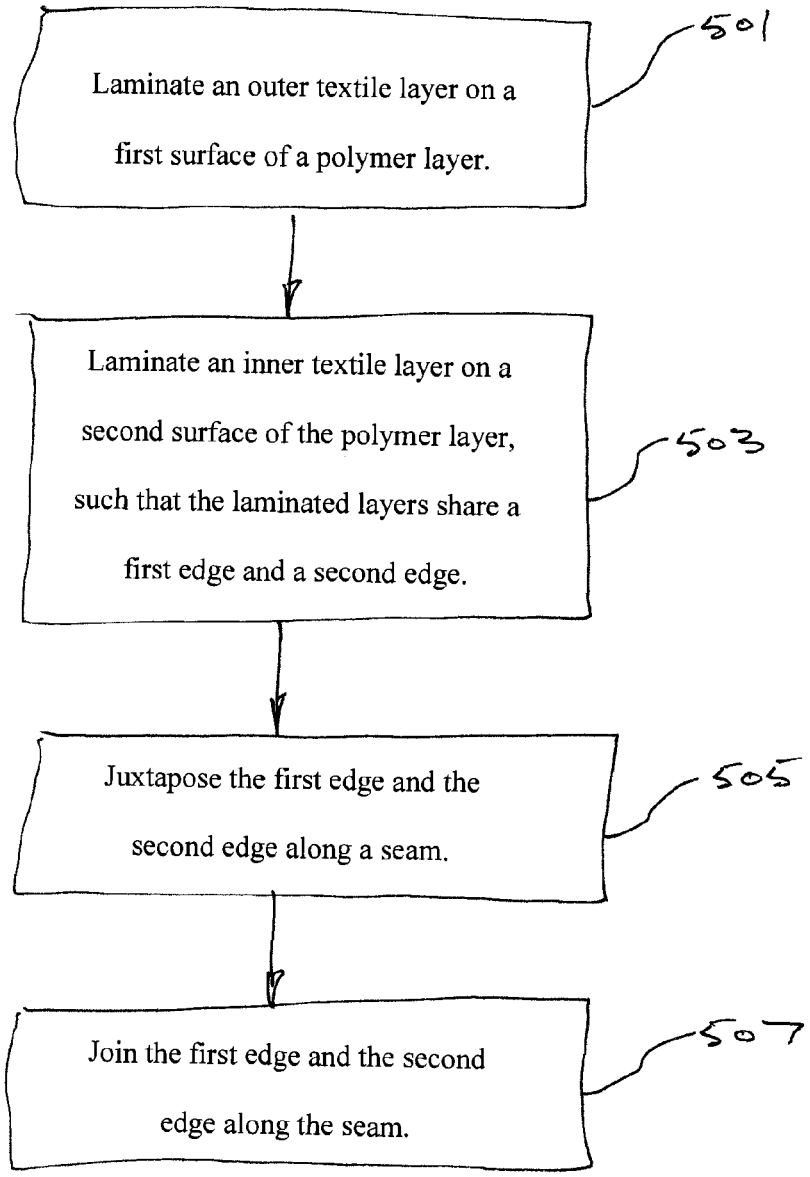
FIG. 5 is a flowchart illustrating a method of manufacturing a writing instrument sheath in accordance with an embodiment of the invention.

Referring to FIG. 5 a flowchart illustrating a method of manufacturing a writing instrument sheath is shown in accordance with an embodiment of the invention. At operation 501, outer textile layer 401 may be laminated on a first surface of polymer layer 403. At this stage, both layers may be sheets of material, e.g., a sheet of woven nylon fabric and a sheet of polychloroprene. Lamination may occur by numerous known manners, including by the application of one or more of heat, pressure, and adhesive. At operation 503, optionally, inner textile layer 405 may be laminated on a second surface, opposite from the first surface of polymer layer 403. Inner textile layer 405 may be a same or different fabric as outer textile layer 401, and may be laminated on polymer layer 403 using similar processes. At operation 505, the composite structure forming wall 106 may be folded into a cylindrical shape in which first edge 301 opposes second edge 409 to form seam 112. At operation 507, seam 112 may be closed by joining the first edge 301 and the second edge 409 along seam 112 with junction 407. As described above, forming junction 407 may involve stitching the edges together with a thread or other medium, e.g., adhesive, to form one or more connection points.

In alternative embodiments, rather than forming writing instrument sheath 100 with a composite structure as described above, writing instrument sheath 100 may be molded in a circular shape. Furthermore, following this molding process, a seam 112 may be introduced through a wall 106 of the molded cylindrical tube and the seam 112 may subsequently be closed using one or more of the techniques described above. In either case, the resulting writing instrument sheath 100 provides a compressible, compliant structure that also remains contiguous when placed over a writing instrument, and which expands over the writing instrument due to the ability of the wall 106, seam 112, and/or junction 407 to stretch and deform.

In an alternative embodiment, writing instrument sheath 100 may be molded in a cylindrical shape and used without forming a seam therein. For example, writing instrument sheath 100 may be formed in a single or multi-layered construction as described herein without the additional formation or closing of a seam. The wholly formed construction may have a generally cylindrical inner diameter and a cylindrical and/or contoured outer diameter as described above. Thus, writing instrument sheath 100 in an embodiment lacks a seam but may nonetheless be used on a writing instrument to provide the comfort that results from some of the other material features described.

Figure 6:
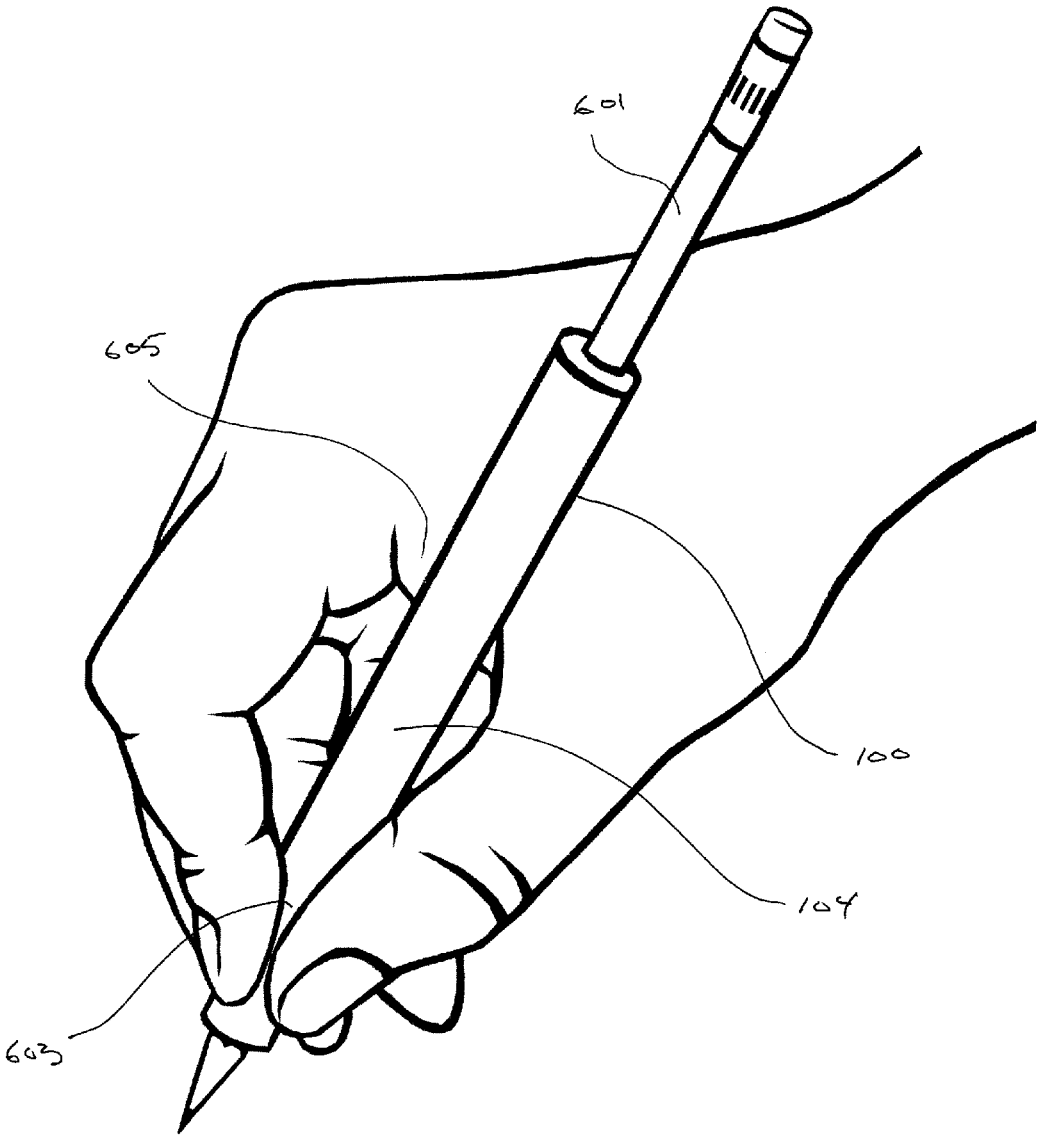
FIG. 6 is a pictorial illustration of a writing instrument sheath being held by a writer in accordance with an embodiment of the invention.

Referring to FIG. 6 a pictorial illustration of a writing instrument sheath being held by a writer is shown in accordance with an embodiment of the invention. A writer may slide writing instrument sheath 100 over an end of a writing instrument 601, such as a pencil, e.g., wooden or mechanical, a pen, or another type of writing instrument, e.g., a stylus. Sliding writing instrument sheath 100 over writing instrument 601 occurs with wall 106 remaining contiguous and distributing a circumferential stress throughout wall 106. Thus, wall 106 stretches to conform to a diameter of writing instrument 601, and therefore, writing instrument sheath 100 can be used on a variety of pens and pencils having different profiles and shapes.

Figure 7:
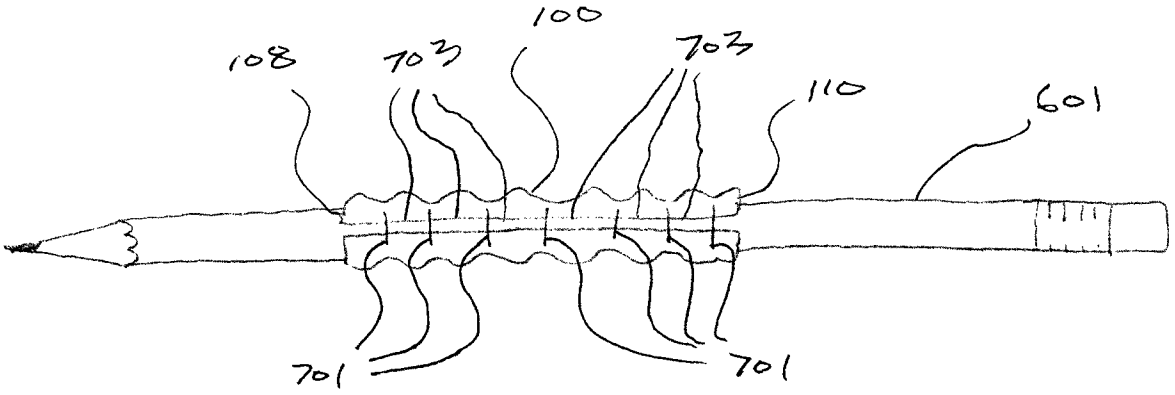
FIG. 7 is a side view illustration of an axially compressed writing instrument sheath over a writing instrument in accordance with an embodiment of the invention.

The writer can grip writing instrument sheath 100 at a grip location 603 on outer surface 104, near a marking end of writing instrument 601. Wall 106 may deform and comply under the pressure applied by the fingers squeezing at grip location 603, and this may facilitate a comfortable grip that reduces hand fatigue. Furthermore, the length of writing instrument sheath 100 may be such that it extends over a substantial portion of writing instrument 601 and rests within oblique arch 605. Thus, in this embodiment, writer's hand is solely in contact with the soft and smooth surface of writing instrument sheath 100. The ergonomics of this gripping configuration are such that pressure points are reduced, providing for a more pleasing writing experience Referring to FIG. 7, a side view of an axially compressed writing instrument sheath over a writing instrument is shown in accordance with an embodiment of the invention. In an embodiment, writing instrument sheath 100 includes seam

112 joined by junction 407 with one or more stitch 701 at various connection points. Writing instrument sheath 100 may also include one or more unconnected points 703. Writing instrument sheath 100 over writing instrument 601 may be axially compressed by placing an axial compression load on first end 108 and second end 110. As the end are pushed toward each other, wall 106 material will bunch up within unconnected points 703, producing an undulating outer surface 104 with peaks approximately centered between the one or more stitch 701 and valleys approximately aligned with the one or more stitch 701 at connection points. Furthermore, when axial loading is removed, the material bunched between the stitches 701 will resist expanding on its own, since the lower diameter portions that are constrained by the stitches 701 provide enough friction to resist longitudinal expansion of writing instrument sheath 100. Thus, until the writer desires for the writing instrument sheath 100 to be lengthened and pulls first end 108 and second end 110 apart, the writing instrument sheath 100 length may be shortened. This shortening ability may be useful, for example, when the pencil has been sharpened to the point that an initial length of writing instrument sheath 100 exceeds the length of writing instrument 601.

In the foregoing specification, the invention has been described with reference to specific embodiments thereof. It will be evident that various modifications may be made to these embodiments without departing from the broader spirit and scope of the invention, as set forth in the following claims. The specification and drawings are, accordingly, to be regarded in an illustrative sense rather than a restrictive sense.

What is claimed is:

1. A writing instrument sheath, comprising:

a cylindrical inner surface;

an outer surface;

a contiguous wall radially intermediate the inner surface and the outer surface, wherein the wall remains contiguous under circumferential stress, wherein the contiguous wall includes a composite structure having an outer textile layer and a polymer layer, and wherein the polymer layer includes a closed-cell foam; and a seam through the contiguous wall.

2. The writing instrument sheath of claim 1 further comprising:

a first end longitudinally separated from a second end by the contiguous wall, wherein the seam extends between the first end and the second end; and a junction joining the contiguous wall along the seam.

3. The writing instrument sheath of claim 2, wherein the seam extends longitudinally between the first end and the second end.

4. The writing instrument sheath of claim 3, wherein the seam includes a length greater than 10 cm between the first end and the second end.

5. The writing instrument sheath of claim 2, wherein the junction comprises a stitch.

6. The writing instrument sheath of claim 5, wherein the stitch is selected from the group consisting of chain, lock, multithread chain, overedge, and cover stitches.

7. The writing instrument sheath of claim 2, wherein the outer surface is on the outer textile layer.

8. The writing instrument sheath of claim 7, wherein the outer textile layer comprises a stretchable fabric.

9. The writing instrument sheath of claim 8, wherein the stretchable fabric is selected from the group consisting of nylon and spandex fabrics.

10. The writing instrument sheath of claim 9, wherein the closed-cell foam is selected from the group consisting of polychloroprene, rubber, polyethylene, silicone, and nitrile foams.

11. The writing instrument sheath of claim 10, wherein the closed-cell foam includes a Shore OO scale durometer less than 30.

12. The writing instrument sheath of claim 11, wherein the polymer layer includes a thickness between 2 to 4 mm.

13. The writing instrument sheath of claim 7, wherein the composite structure further comprises an inner textile layer, the inner surface on the inner textile layer.

14. The writing instrument sheath of claim 2, wherein the outer surface is configured to be printed upon.

15. The writing instrument sheath of claim 14, wherein the outer surface comprises one or more gripping features selected from the group consisting of indentations, bumps, holes, and ridges.

16. The writing instrument sheath of claim 1 further comprising a first end longitudinally separated from a second end by the contiguous wall, wherein the first end includes a first end wall, and wherein the outer textile layer and the polymer layer are exposed at the first end wall.

17. A method of fabricating a writing instrument sheath, comprising:

laminating an outer textile layer on a first surface of a polymer layer, wherein the laminated layers share a first edge and a second edge, and wherein the polymer layer includes a closed-cell foam;

juxtaposing the first edge and the second edge along a seam with the outer textile layer radially outward from the polymer layer; and joining the first edge and the second edge along the seam.

18. The method of claim 17, wherein laminating further includes laminating an inner textile layer on a second surface of the polymer layer, wherein the inner textile layer shares the first edge and the second edge with the polymer layer and the outer textile layer.

19. The method of claim 17, wherein joining further includes stitching the first edge to the second edge.

20. The method of claim 17, wherein the closed-cell foam includes a closed-cell polychloroprene foam.

* * * * *